United States Patent [19]

Krausse

[11] Patent Number: 4,721,891

[45] Date of Patent: Jan. 26, 1988

[54] AXIAL FLOW PLASMA SHUTTER

[75] Inventor: George J. Krausse, Fort Collins, Colo.

[73] Assignee: The Regents of the University of California, Berkeley, Calif.

[21] Appl. No.: 853,103

[22] Filed: Apr. 17, 1986

[51] Int. Cl.[4] ..... H01J 17/14

[52] U.S. Cl. ..... 315/340; 315/344; 313/156; 313/161

[58] Field of Search ..... 315/344, 340, 335, 338; 313/155, 156, 157, 158, 159, 161, 231.31; 501/17; 200/147 R, 147 B, 144 B

[56] References Cited

U.S. PATENT DOCUMENTS

| | | | |
|---|---|---|---|
| 3,881,127 | 4/1975 | MacMaster et al. | 313/157 X |
| 4,071,801 | 1/1978 | Harvey | 315/344 |
| 4,088,929 | 5/1978 | Weldon | 315/344 X |
| 4,156,159 | 5/1979 | Takagi | 313/155 |
| 4,429,007 | 1/1984 | Bich et al. | 501/17 X |
| 4,475,006 | 10/1984 | Lee | 315/344 |
| 4,581,118 | 4/1986 | Class et al. | 313/156 X |
| 4,596,945 | 6/1986 | Schumacher et al. | 315/344 |

*Primary Examiner*—David K. Moore
*Assistant Examiner*—Mark R. Powell
*Attorney, Agent, or Firm*—University of California Patent Office

[57] ABSTRACT

A shutter (36) is provided for controlling a beam, or current, of charged particles in a device such as a thyratron (10). The substrate (38) defines an aperture (60) with a gap (32) which is placeable within the current. Coils (48) are formed on the substrate (38) adjacent the aperture (60) to produce a magnetic field for trapping the charged particles in or about aperture (60). The proximity of the coils (48) to the aperture (60) enables an effective magnetic field to be generated by coils (48) having a low inductance suitable for high frequency control. The substantially monolithic structure including the substrate (38) and coils (48) enables the entire shutter assembly (36) to be effectively located with respect to the particle beam.

17 Claims, 7 Drawing Figures

Fig. 1
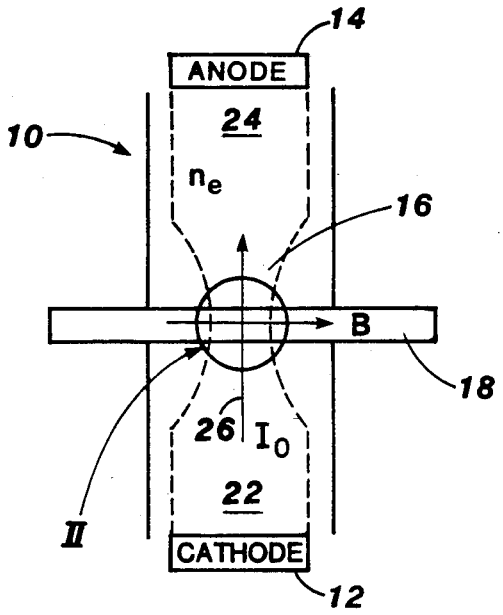
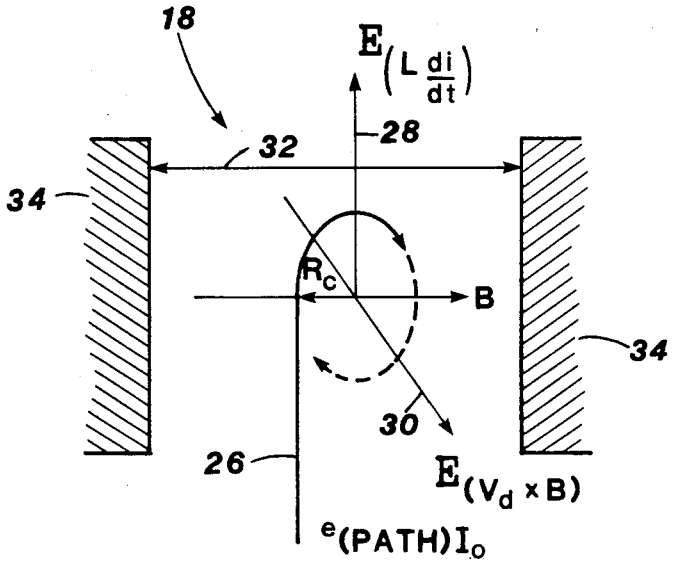
Fig. 2

Fig. 3
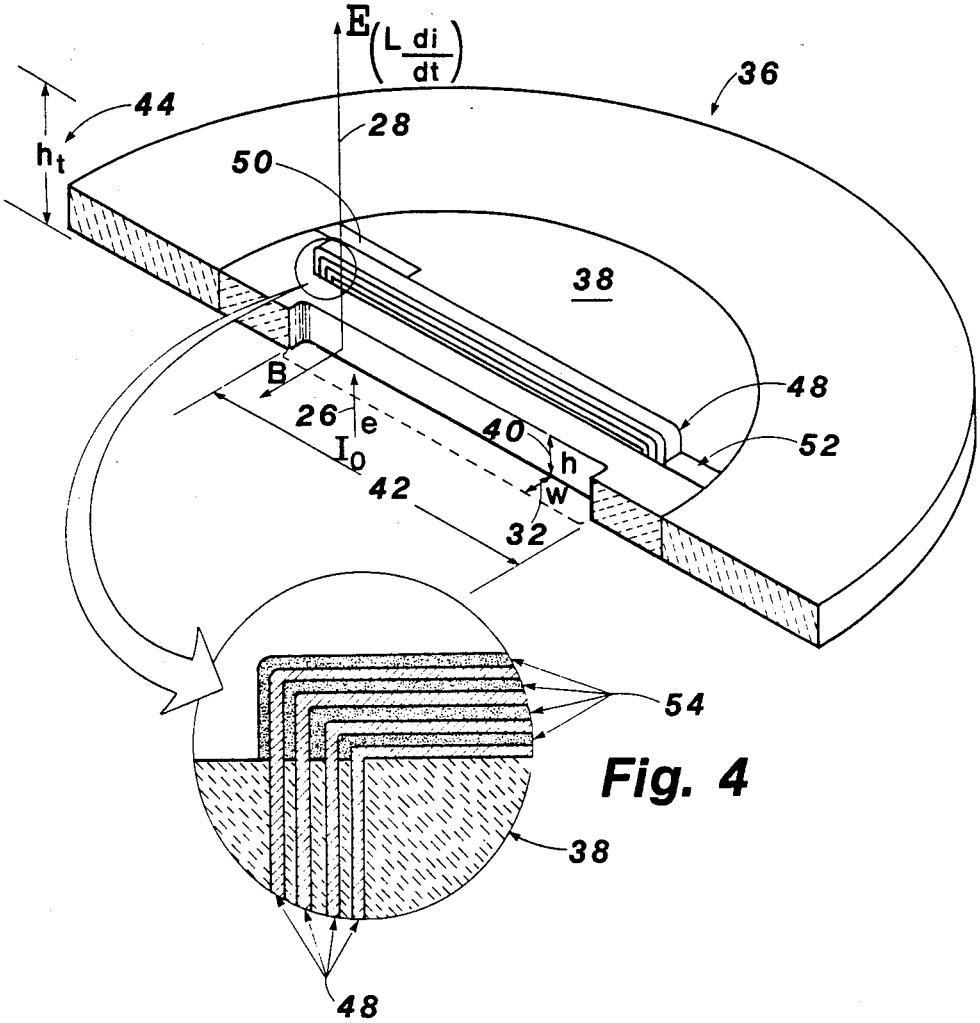
Fig. 4
Fig. 5
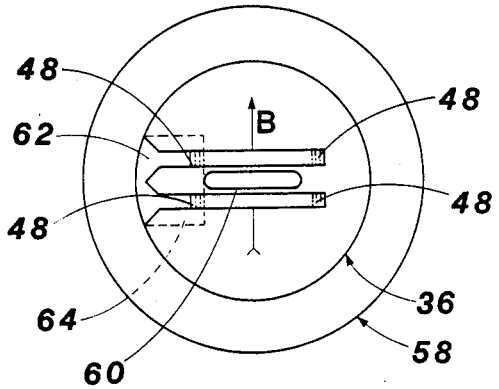

Fig. 6A
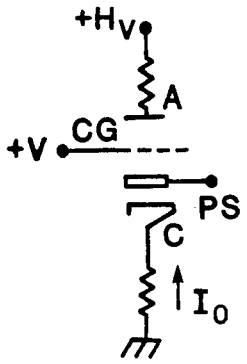
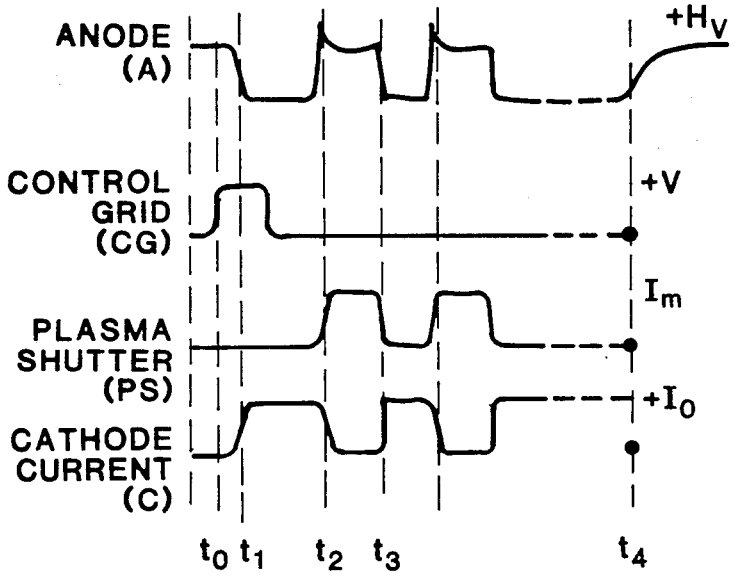
Fig. 6B

AXIAL FLOW PLASMA SHUTTER

This invention is the result of a contract with the Department of Energy (Contract No. W-7405-ENG-36).

FIELD OF INVENTION

This invention generally relates to controlling the flow of charged particles by interaction with a magnetic field and, more particularly, to apparatus generating a magnetic field to quench a plasma discharge by effecting the ionizing electrons.

BACKGROUND OF THE INVENTION

There are many electrical devices which emit high energy electrons from a heated cathode for transport along an electrical field to an anode. In some devices a low pressure gas as included between the cathode and the anode for interaction with the emitted electrons. In one mode of interaction the electrons collide with the gas molecules and when enough energy is delivered in a collision the gas molecule may be ionized to also generate another electron. Thus, the initial emitted electrons may produce a cascading ionization to transmit substantial power through the device.

The highly ionized gas resulting from the collisions is called herein a "plasma" and the electrical charge flow associated with movement of the plasma constitutes current flow. Once a plasma condition is initiated it is relatively self-sustaining until the electron flow is interrupted or until the plasma is cooled below the energy levels necessary for ionization.

A conventional device using the high power capability of a plasma flow is a thyratron. A control grid is provided between the cathode and the anode for accelerating the emitted electrons from the cathode to an energy adequate to initiate the cascading ionization. Thereafter, voltage on the control grid may be removed with no effect on the plasma flow. Conventional attempts to terminate the plasma flow are slow-acting, require large amounts of energy, and frequently affect a substantial portion of the plasma volume such that reformation of the plasma does not readily occur.

Conventionally, the switching, or quenching, of the plasma uses external coils for affecting the net electromagnetic field within the device. A coil which produces the required magnetic field typically has a large inductance from the external coil size needed to affect the interior volume. High frequency operation is not practical with such large volume external coils.

In a prior art device described in U.S. Pat. No. 4,071,801 to Harvey, a concentric electrode device is described where an axial magnetic field accelerates electrons in a spiral annular path between the electrodes to generate the cascading ionization. An off-switching magnetic field coil is provided at an off-axis location to generate a magnetic field in a relatively small portion of the annular volume. A tangentially oriented magnetic field is produced which affects the electron path to intersect with the anode and remove electrons. As taught by the reference, the auxiliary field coil produces an off-axis perturbation in the main magnetic field such that sufficient electrons are eventually removed from the volume to switch off the plasma.

Thus, one object of the present invention is rapid quenching of a plasma flow.

Another object of the present invention is to provide for pulse-type response in a device having ionized gas flow.

Still another object is to control a hot gas device.

One other object of the present invention is to maintain significant volumes of the gas in a state conducive to rapid reinitiation of plasma flow after quenching.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the apparatus of this invention may comprise a plasma shutter for use in pulsing a cascading ionization device. The shutter is provided with a substrate which is placeable within a plasma and which defines an aperture having a minimal area which still enables initiation of the cascading ionization. A conductor is disposed on the substrate in coils adjacent to the aperture. The coils are oriented for producing a magnetic field which is substantially perpendicular to movement of the plasma. Placing the magnetic coils in the plasma adjacent a reduced area aperture receiving the plasma assists in achieving the objects of the present invention.

In another characterization of the present invention, a switch is provided for controlling charged particle currents in devices such as particle accelerators. A shutter which is placeable within the device defines an aperture substantially normal to the flow of charged particles forming the current. The aperture further defines an internal volume which is relatively small in comparison with adjacent internal volumes of the device. A coil is provided to obtain a magnetic field within the aperture and perpendicular to the particle flow where the field has a strength producing a circular path of the particle about the magnetic field, the circular path having a circumference functionally related to a mean free path of the particles forming the current flow to control the current.

In another embodiment of the present invention, a method is provided for quenching plasma flow between a cathode and an anode. The plasma flow is confined through an aperture having a gap width for receiving the plasma and an area which is small relative to the area of the cathode and the anode. A magnetic field is generated across the gap and perpendicular to the plasma flow where the magnetic field has a strength effective to produce a motion of the electrons forming the plasma flow in a circular path having a circumference which is no longer than a mean free path of the electrons.

In a particular embodiment of the present invention, a high frequency pulsed thyratron is provided with a housing containing a cathode, an anode, a control grid and an ionizable gas for producing a plasma flow, with a plasma shutter disposed within the housing between the anode and cathode for receiving and magnetically trapping electrons forming the plasma flow.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings:

FIG. 1 is a simplified illustration of one embodiment of a plasma shutter according to the present invention in a cascading ionization device.

FIG. 2 more particularly illustrates interaction of the plasma shutter with electrons forming the plasma flow.

FIG. 3 is a pictorial representation of one embodiment of a shutter according to the present invention.

FIG. 4 is a cross section of the device shown in FIG. 3.

FIG. 5 is a front view of a shutter assembly incorporating the shutter depicted in FIG. 3 and adapted for use in a thyratron.

FIG. 6A is a schematic diagram including a conventional thyratron with a plasma shutter installed.

FIG. 6B is a graphic representation showing the response of the circuit depicted in FIG. 6A with the installed plasma shutter.

DETAILED DESCRIPTION OF THE INVENTION

FIG. 1 illustrates one embodiment of a cascading ionization device, such as thyratron 10, with installed plasma shutter 18. Cathode 12 conventionally includes a surface which emits electrons when the cathode 12 is heated. An electric field is applied between cathode 12 and anode 14, typically as an electromotive potential applied to anode 14 to cause the emitted electrons to move from cathode 12 to anode 14.

A low pressure gas is included between cathode 12 and anode 14 and the emitted electrons collide with gas molecules to excite the gas molecules. When the gas molecules have acquired sufficient energy from the collisions, ionization may occur where an electron is removed from the molecule and accelerated for subsequent collisions and ionizations. A condition is reached in cathode ionization volume 24 and anode ionization volume 26 where the ionizations cascade from the removed electrons, producing a highly ionized gas, or plasma, condition within device 10. The plasma enables a large current $I_0$ to be maintained within device 10 such that a large power capability is provided. FIG. 1 further depicts a slightly reduced volume 16 which symbolically represents a volume within which a control grid and a baffle may be included in conventional thyratron 10 arrangement.

FIG. 1 further depicts plasma shutter 18 disposed within device 10 between cathode 12 and anode 14. As shown in FIG. 1, shutter 18 is within the reduced volume portion 16 and further adjacent a control grid (not shown), although no operative relationship should be inferred. A magnetic field B is produced within plasma shutter 18 perpendicular to plasma flow $I_0$ to quench plasma flow in both anode volume 24 and cathode volume 22.

FIG. 2 more particularly depicts interaction of an electron 26 with a magnetic field B within shutter aperture gap 32 formed by magnetic pole pieces 34. According to the present invention, the plasma flow may be quenched in the adjacent volumes 22 and 24 (FIG. 1) if electrons 26 entering gap 32 are trapped, i.e., removed from ionizing interaction with gas molecules. The condition to be obtained is to wrap an electron 26 about a single flux line forming magnetic field B such that the circumference traveled by an electron 26 in one revolution about a B line is no more than one mean free path (λ) of an electron.

By trapping electrons 26 within gap 32 of plasma shutter 18, any plasma with electron densities ($n_e$) in the range of $10^{13}$ to $10^{16}$ particles per $cm^3$ may be quenched. These densities are within the operating range of thyratrons and lasers within which the shutter may be used. It will be appreciated that magnetic field B is applied across a relatively small gap 32 and includes a small volume relative to main volumes 22 and 24 (FIG. 1) within which the cascading ionization occurs.

Thus, a minimum magnetic field is defined where:

$$\lambda = 2\pi R_c \tag{1}$$

Further, $$R_c = \frac{Me\bar{V}}{q_e B} \tag{2}$$

where λ equals the mean free path of an electron, $R_c$ equals the radius of curvature of the electron path, $E_b$ equals the mass of an electron, $\bar{V}$ equals the instantaneous velocity of an electron, $q_e$ equals the charge on an electron, and B equals the magnetic field flux density in tesla (T).

Also, in a plasma, $$\lambda = \frac{M_e V_d \bar{V}}{q_e E}. \tag{3}$$

where, $$V_d = \frac{I_o}{n_e A q_e}. \tag{4}$$

$V_d$ equals drift or average electron velocity, E equals applied cathode-anode electric field, $I_0$ equals plasma current, $n_e$ equals electron density, A equals area of shutter aperture. Combining equations (1)–(4), the minimum magnetic field strength to enable quenching of the plasma is defined by:

$$B = \frac{2\pi E n_e A q_e}{I_o}. \tag{5}$$

Equation (5) defines an initial condition for quenching the plasma. Once quenching is initiated, the term defined by $I_0$ begins to approach zero, other electromagnetic field vectors arise, such as the inductive current decay field in vector 28, $L(^{di}/dt)$, arising from electron motion in a magnetic field. These conditions arise in the quenching transient, and are not further discussed.

In accordance with the present invention, the magnetic field density B is minimized by minimizing the aperture area A. Referring now to FIG. 3, the aperture area is defined by shutter aperture width, or gap 32, dimension "w", and shutter aperture length 42 dimension. In accordance with the present invention coil conductors 48 are placed closely adjacent gap 32 to obtain the desired magnetic field density B within gap 32 from the coil having minimum winding and current requirements and minimizing inductive delays arising from coils 48.

In a demonstrable embodiment, shutter disk assembly 36 may be placed within an existing thyratron. For this embodiment, the following dimensions arise: h (40)=1.5 mm, w (32)=2.5 mm, l (42)=1.4 cm, aperture area $A=3.5\times10^{-5}$ m$^2$. Then, in a typical thyratron application, the following operational parameters exist: $I_0=1\times10^3$ A, E=100 V, $n_e=1\times10^{20}$ part/m$^3$. Using Equation (5), a minimum magnetic field density of B=0.058 T is found to be required within the aperture defined by shutter disk 38.

As hereinafter shown, this magnetic field intensity can be produced by a coil configured as depicted in FIG. 3 and having inductance and resistance characteristics suitable for operation at pulse rates significantly higher than available in known apparatus. Such coil characteristics provide the capability of controllable thyratrons having significant power gains and useful in analog configurations. However, a first threshold showing is whether the required magnetic field can penetrate the plasma within gap 32 in a time compatible with a desired pulse.

Full penetration of the plasma by the field is necessary to establish the conditions necessary for quenching the plasma. It can be shown that the skin depth of the plasma at a frequency corresponding to the anticipated pulse will be large relative to the dimension of gap 32 and the skin depth will thus be set to the dimension of gap 32. Then it can be shown that the time constant for penetrating the plasma is defined by:

$$T=\frac{\mu_o\sigma\delta^2}{4\pi} \tag{6}$$

If it is now assumed that five time constants are required for a quenching penetration, penetration will occur in $t_q=1.6\times10^{-14}$ seconds. Thus, the time for the magnetic field to penetrate the plasma and establish quench conditions is not a limiting factor since an anticipated pulse rise time is about $25\times10^{-9}$ seconds, many orders of magnitude slower.

The physical characteristics of the coil depicted in FIG. 3 are hereinafter evaluated to demonstrate the operating characteristics of a coil which achieves the objectives hereinabove set forth. It will be appreciated that shutter disk assembly 36 must be placed within the plasma flow and must withstand this flow. A suitable shutter disk assembly 36 has been fabricated using ceramic-like materials placeable within plasma conditions. Thus, disk 38 may be fabricated from a ceramic material, such as alumina. Numerous suitable ceramic materials exist other than alumina, however, which can be fabricated with the required dimensions and with the required plasma resistance.

Coils 48 are then fabricated on disk 38, as shown in FIG. 4. Four windings are shown in FIGS. 3 and 4, forming coil assemblies 48 adjacent the disk aperture. A conductive frit is fired on a substrate 38 to form first current connector 52 and second current connector 50 for energizing coil 48. It will be appreciated that a second coil is disposed adjacent the shutter aperture as hereinafter depicted in FIG. 5.

Referring again to FIG. 4, ceramic disk 38 is drilled with passages necessary to form windings 48. Windings 48 are formed from a conductive frit, which may be copper disposed in a glass frit forming coil conductors 48. Openings through ceramic disk 38 are first filled with the conductive frit. Alternating layers of a conductive frit 48 and an insulative frit 54, which may be a colored gas frit, are alternatively placed to form the coil configuration depicted in FIG. 4. The entire shutter disk assembly 36 may then be conventionally fired, e.g., at 800° C., to form a ceramic assembly which is substantially monolithic in character. The resulting conductive portions 48 after firing have a conductivity approaching that of the conductor used to load the glass frit. Further, the insulative layers 54 encapsulate the conductive layers such that there is no turn-to-turn flashover when a current pulse is applied. Furthermore, the conductive plasma can not short circuit the current conductors 48 forming the quenching magnetic field.

FIG. 5 depicts shutter disk assembly 36 with mounting ring 58 for placing within an operating thyratron. A pair of coils 48 are disposed adjacent aperture 60. Conductors 62 and 64 establish the necessary current connections for coils 48. When coils 48 are pulsed, a magnetic field vector B is produced which causes electrons within aperture 60 to wrap about single flux lines forming magnetic field B and obtain the conditions established by Equation (5) to trap the electrons within aperture 60.

The characteristics of coil 48 may now be derived to verify that various operating objectives have been met. The coil configuration depicted in FIGS. 3, 4, and 5 may be shown to have an inductance defined by $$L=\frac{4N^2\mu_o h(X^2+R^2)^{\frac{1}{2}}}{\pi R} \tag{7}$$

The current required to produce the magnetic field within a coil of this configuration is further defined by $$I_m=\frac{\pi R(X^2+R^2)^{\frac{1}{2}}B}{2N\mu_o X} \tag{8}$$

In Equation (7) and (8), N equals the number of coil turns, X equals an effective coil length, R equals an effective mid-point between coil turns, and $I_m$ equals magnet (coil) current. In the demonstrative embodiment for application to a thyratron, X=7 mm, R=2.5 mm, N=4.

Then, for the coil producing the minimum magnetic field B=0.058 T, a coil having an inductance of 57 nH per coil is needed, or 28 nH for the parallel coils. An exciting current of 48 A/coil, or 96 A for the two coils, is needed.

Similarly for the two coils in parallel, the resistance is determined from $$R=\frac{L_{cw}}{2\sigma_c(T_{cw}W_{cw})} \tag{9}$$

where $L_{cw}$ equals coil winding length, $T_{cw}$ equals coil winding thickness, $W_{cw}$ equals coil winding width, and $\delta_c$ equals coil conductivity (equivalent to copper, $6\times10^7$ mhos/meter). In the demonstrative thyratron configuration, $L_{cw}$=0.112 m, $T_{cw}$=0.0127 mm, $W_{cw}$=2.0 mm. It is noted that $T_{cw}$ is an effective conductor thickness, which may be limited to a skin depth dimension at operating frequencies. However, at the desired step rise time of 25 ns, the skin depth for a conductor having a conductivity close to copper is large relative to the conductor thickness forming the coils herein described. Thus, the calculated resistance is $R=0.055$ ohms.

Yet another figure of merit to evaluate coil operation is the anticipated power dissipation requirement. The duty cycle for the coils depicted in FIG. 3 and configured for the thyratron demonstration unit can be assumed to have duty cycle equal to the duty cycle for the thyratron. A thyratron duty cycle is defined to be the ratio of the average to the peak current and for the illustrated thyratron, a duty cycle of $1.67\times10^{-4}$ is obtained, which is a relatively typical duty cycle for thyratron operation. Since $$I_{ave} = I_m(\text{peak}) \cdot (d.c._{thy}) = (96\text{A})\,(1.67 \times 10^{-4}) = 0.0153\text{A},$$

for coil 48 the average power dissipation requirement for the coil windings is $$P_{cw} = I_{ave}^2 R = (0.0153\text{A})^2\,(0.055 \text{ ohms}) = 1.29 \times 10^{-5} \text{ watts.} \quad (10)$$

This power dissipation requirement is substantially less than the capability for the ceramic-type materials forming the substrate and windings of shutter disk assembly 36.

In summary, it is expected that coil 48, depicted in FIGS. 3, 4, and 5 and hereinabove described, will produce a magnetic field B within shutter aperture 60 which is effective to quench the plasma flow with the following operating parameters: $L_c=28$ nH, $R_c=0.055$ ohms, $I_m(\text{peak})=96$ A, $I_m(\text{avg.})=0.0153$ A, $P_{cw}=13\times10^{-6}$ watts.

As hereinabove discussed, the time required for the magnetic field to penetrate the plasma is much less than the anticipated step rise time of 25 ns. The quenching time for the plasma will then depend on the time for the coil current to reach the current value $I_m=96$ A to establish the minimum quenching field density of $B=0.058$ T. For the coil inductance computed for the demonstrative embodiment, a voltage of 107 V is needed to produce the desired current over the step time interval.

The voltage and current values derived above further indicate that the plasma shutter can be a significant control device. If a square wave pulse is applied to the shutter, the peak power required to operate the shutter is about 10 kW. This power controls a peak thyratron output of 5 MW for a power gain of about 500.

Referring now to FIGS. 6A and 6B, the expected operation of a thyratron equipped with a plasma shutter according to the present invention is graphically set out. FIG. 6A schematically represents a conventional thyratron with a plasma shutter PS placed within the thyratron. It is expected that the plasma shutter PS will be adjacent the control grid CG and may be positioned on either side of the control grid CG as indicated by performance of any particular thyratron.

Installation of a plasma shutter PS in a conventional thyratron will modify the commutation, conduction, and recovery cycles as depicted in FIG. 6B. For a time, $t<t_0$, the thyratron is in its quiescent state. At $t_0$ a positive trigger is applied to control grid CG to accelerate electrons emitted by cathode C and cause a thyratron to avalanche into conduction at $t_1$. Once the cascading ionization is completed to establish the plasma flow, the voltage on control grid CG may be removed without effect on the plasma.

A current pulse is applied to plasma shutter PS at $t_2$ to quench the plasma, reducing the cathode current $I_0$ to zero. A corresponding inductive voltage term, $L^{di}/dt$, is induced on the anode, which thereafter returns to the high voltage $H_v$, as the plasma in the thyratron is quenched.

It will be appreciated that plasma shutter PS has affected a relatively small volume of the ionized gas within the thyratron and, referring to FIG. 1, the gas within cathode volume 22 and anode volume 24 remains at high levels of energy and conductivity. Thus, when plasma shutter PS is shut off at $t_3$, i.e., the magnetic field B is removed, the electron cloud trapped within plasma shutter PS can initiate an avalanche condition to switch on the thyratron at a substantially faster time than required to initially place the thyratron in a plasma condition. By affecting only a relatively small volume of the ionized gas and simply trapping the electrons, plasma shutter PS enables the thyratron to remain at an overall high energy level and in a conductive state which readily resumes a plasma flow when the trapping magnetic field is removed. Thus, the repetition rate for operating the thyratron is now limited only by the plasma shutter itself and its driving circuit. It is expected that a repetition rate in the range of 1–10 MHz should be available.

The foregoing embodiment of the shutter depicted in FIGS. 3, 4, and 5 is specifically directed to a thyratron. It should be realized, however, that the monolithic structure shown in FIGS. 3, 4, and 5 is generally adaptable for use to control beams of charged particles. Equations (1)–(8) are applicable to a current of charged particles and can be used to define operative embodiments of the present invention to wrap charged particles about magnetic flux lines to trap the charged particles in or about gap 32 defining aperture 60. Particle beam devices include particle beam accelerators and free electron beams.

The foregoing descriptions of the preferred embodiment of the invention have been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A plasma shutter for use in pulsing a cascading ionization device, comprising:

an insulative substrate placeable to intercept a plasma flow and defining an aperture having a minimum area for passage of said plasma flow and enabling initiation of said cascading ionization; and conductor means disposed on said substrate and defining coils for placing within said plasma adjacent said aperture and oriented for producing a magnetic field substantially perpendicular to movement of said plasma, wherein said magnetic field is producible with a strength effective to wrap electrons forming said plasma about flux lines defined by said magnetic field to a radius defining a circumference no longer than a mean free path for said electrons to quench said cascading ionization in said device.

2. A plasma shutter according to claim 1, wherein said aperture has a gap dimension which enables magnetic field permeation of said plasma at a time constant effective for a frequency selected for said pulsing.

3. A plasma shutter according to claim 1, wherein said conductor means includes alternating layers of conductive material and insulative material forming a monolithic coil structure.

4. A plasma shutter according to claim 3, wherein said conductive material is formed from a glass frit loaded with a conductor and said insulative material is formed from a glass frit.

5. A switch for controlling a flow of charged particles including electrons through internal volumes of a cascading ionization device, comprising:

shutter means placeable to intercept said flow of charged particles and defining an aperture substantially normal to said charged particle flow, said aperture further defining an internal volume relatively small in comparison with adjacent ones of said internal volumes accepting said charged particles; and coil means adjacent said aperture effective for producing a magnetic field within said aperture and perpendicular to said charged particle flow having a strength effective for creating a circular path of said electrons about said magnetic field with a circumference functionally related to a mean free path of said electrons for trapping said electrons in said aperture to quench said cascading ionization in said device.

6. A switch according to claim 5, wherein said coil means comprises:

conductor elements formed as windings adjacent said aperture for locating within said current flow.

7. A switch according to claim 5, wherein said aperture has a gap width dimension small relative to a gap length dimension.

8. A switch according to claim 6, wherein said conductor elements include alternating layers of conductive material and insulative material forming a monolithic coil structure.

9. A switch according to claim 8, wherein said conductive material is formed from a glass frit loaded with a conductor and said insulative material is formed from a glass frit.

10. A method for quenching plasma flow between a cathode and an anode, comprising the steps of:

confining said plasma flow through an aperture having a gap width for receiving said plasma and an area which is small relative to said cathode and anode: and generating a magnetic field across said gap and perpendicular to said plasma flow, said magnetic field having a strength effective to produce motion of electrons forming said plasma flow in a circular path having a circumference no longer than a mean free path of said electrons.

11. A method according to claim 10, including the step of:

placing within said plasma flow an insulative substrate defining said aperture and having conductive windings thereon for generating said magnetic field.

12. A method according to claim 11, further including the step of locating said conductive windings adjacent said gap a distance effective to generate said magnetic field and control a power output of said plasma with a relatively small power input to said conductive windings.

13. A high frequency pulsed thyratron including a housing containing a cathode, an anode, a control grid and an ionizable gas for producing a plasma flow, the improvement comprising:

a plasma shutter disposed within said housing between said anode and cathode for receiving and magnetically trapping electrons forming said plasma flow, said shutter including an insulative substrate defining an aperture for receiving said plasma flow; and conductive windings on said substrate adjacent said aperture for generating a magnetic field in said aperture substantially perpendicular to said plasma flow effective to trap said electrons and quench said plasma flow.

14. The thyratron of claim 13, wherein said aperture has an area receiving said plasma flow reduced from areas for said cathode and anode.

15. The thyratron of claim 13, wherein said aperture has a small included volume relative to adjacent volumes containing said ionizable gas within said housing.

16. The thyratron of claim 13, wherein said conductor elements include alternating layers of conductive material and insulative material forming a monolithic coil structure.

17. The thyratron of claim 16, wherein said conductive material is formed from a glass frit loaded with a conductor and said insulative material is formed from a glass frit.

* * * * *